United States Patent [19]

Johansson

[11] 4,234,864

[45] Nov. 18, 1980

[54] TRANSFORMER WITH OFFSET SIDE WALL-MOUNTED ON-LOAD TAP CHANGER

[75] Inventor: Birger Johansson, Ludvika, Sweden

[73] Assignee: ASEA Aktiebolag, Västeras, Sweden

[21] Appl. No.: 47,644

[22] Filed: Jun. 11, 1979

[30] Foreign Application Priority Data

Jun. 16, 1978 [SE] Sweden ..... 7806937

[51] Int. Cl.[3] ..... H01F 27/04

[52] U.S. Cl. ..... 336/90; 174/18; 336/105

[58] Field of Search ..... 200/11 TC; 174/18; 361/268; 336/90, 92, 94, 105, 107, 150

[56] References Cited

U.S. PATENT DOCUMENTS

| | | | |
|---|---|---|---|
| 1,891,959 | 12/1932 | Sprong | 336/94 X |
| 3,621,426 | 11/1971 | Bennon | 336/90 X |

*Primary Examiner*—Thomas J. Kozma

*Attorney, Agent, or Firm*—Watson, Cole, Grindle & Watson

[57] ABSTRACT

A transformer, with a core and windings, is arranged in a liquid-filled transformer tank and provided with an on-load tap changer suspended from the outside of the side wall of the tank. The terminal board between the tap changer and the tapping points of the transformer is arranged to incline at an angle of, for example, 30° from the vertical plane.

4 Claims, 2 Drawing Figures

TRANSFORMER WITH OFFSET SIDE WALL-MOUNTED ON-LOAD TAP CHANGER

BACKGROUND OF THE INVENTION

1. Field Of The Invention

The present invention relates to liquid-filled transformers having tap changers and more particularly to the structure for mounting such tap changers to the transformer tank.

2. Prior Art

On-load tap changers for small and medium-sized regulating transformers are often designed as so-called selector switches, which means that the duties of the tap selector and the diverter switch are combined into one unit. Such a selector switch is usually located in an oil-filled tank mounted onto the transformer tank and separated therefrom by means of an oil-tight barrier, in which a terminal board having terminals for connection of the transformer taps is arranged Normally, an on-load tap changer of the above type is located so that the terminal board lies parallel to the transformer winding in a vertical direction. Space must then be accommodated at the upper part of the transformer tank for connecting conductors from the regulating winding to the terminal board of the tap changer, which results in an increase of the height of the transformer tank. Another drawback with this manner of enclosure is that the terminal board of the tap changer is only accessible for connection from above through the opening which is normally covered by the cover of the transformer tank. For the person carrying out the connection work this means an uncomfortable operating position and other disadvantages from the point of view of the work environment. In certain cases, for example, the fitter has to perform the connection in a lying position on top of the upper yoke of the transformer core while the core and the windings are still hot from oil impregnation. Such mounting also results in the tap changer being positioned at such a high level above the ground that it can no longer be mechanically built together with its associated operating device, which has to be arranged separately at a height suitable for operation. This requires a special mechanical transmission between the operating device and the tap changer, which results in an increase in costs.

In another frequently used design, the tap changer is mounted on an intermediate portion protruding from one end wall of the transformer tank. This intermediate portion is provided with side openings to enable the necessary connection of the tap changer to the transformer winding. This alternative structure causes an increase in the dimensions of the transformer.

SUMMARY OF THE INVENTION

The primary purpose of the invention is to achieve a transformer with an on-load tap changer of the type located in a liquid-filled tap changer tank on the outside of the transformer tank, in which the above-mentioned drawbacks are avoided. This is accomplished by arranging the terminal board of the tap changer in an inclined position in relation to the vertical plane, such that no increase of the height of the tank is necessary while accessibility for the necessary interconnections are considerably improved.

BRIEF DESCRIPTION OF THE DRAWINGS

The invention will be explained in greater detail with reference to the accompanying drawing, in which.

DETAILED DESCRIPTION

Figure 1:
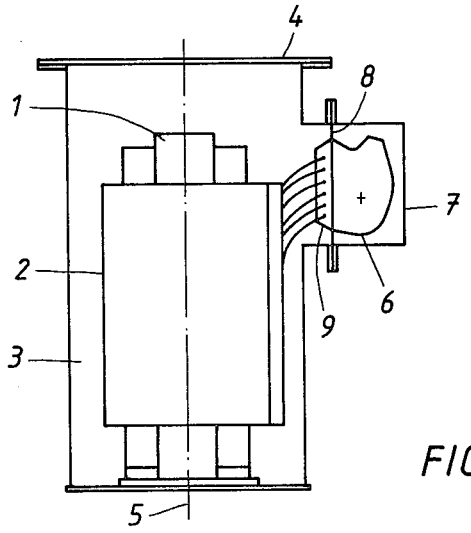
FIG. 1 shows a schematic cross-section of a transformer having an on-load tap changer of conventional design, whereas FIG. 2 in a corresponding way shows an embodiment of the invention.

The transformer shown in FIG. 1 comprises iron core 1 with winding 2 arranged in oil-filled transformer tank 3 with cover 4. The transformer winding is oriented with axial line 5 in a vertical direction. On the outside of one side wall of transformer tank 3 there is mounted on-load tap changer 6 of a selector switch type mounted in oil-filled tap changer tank 7 with a built-on operating device. Tap changer tank 7 is provided with a flange (not shown) for mounting by bolts to the corresponding flange on transformer tank 3. At parting line 8 between transformer tank 3 and tap changer tank 7, tap changer 6 is provided with an oil-tight barrier, in which is arranged terminal board 9 with terminals for connection of the transformer taps. Tap changer 6 is located so that the barrier with terminal board 9 is positioned parallel to axial line 5 of the transformer winding.

Figure 2:
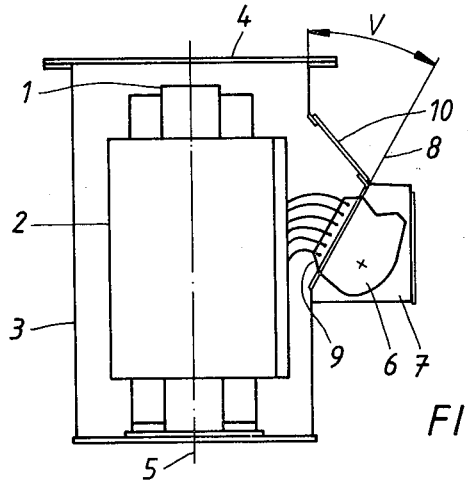

FIG. 2 shows the construction of a transformer with a tap changer according to the invention. In this design terminal board 9, arranged at the parting line between transformer tank 3 and tap changer tank 7, is arranged to be inclined outwardly and upwardly from the vertical plane, in which the side wall of transformer 2 is substantially situated. The portion of the side wall of transformer tank 3 which is located above terminal board 9, inclines outwardly and downwardly from the same vertical line and is provided with an opening with cover 10, through which opening terminal board 9 is accessible. This design makes possible a reduction of the height of transformer tank 3, while also improving the accessibility for the connection. Additionally, tap changer 6 with its built-on operating device can be located at such a height above the ground surface as is suitable in view of the operational requirements therefor.

In the shown embodiment, angle v between parting line 8 and vertical axis 5 is approximately 30°, but this angle can be varied within wide limits, for example between 15° and 60°, without departing from the inventive concept.

Tap changer tank 7 and transformer tank 3, which are separated by an oil-tight barrier, need not necessarily consist of two separate tanks joined by a bolt joint but may also be built integral with each other.

What is claimed is:

1. Transformer apparatus comprising:

a liquid-filled transformer tank;

a transformer core and windings mounted within said transformer tank, and at least one of said windings including tapping points;

a tap-changer tank mounted on the outside of one side wall of said transformer tank;

an on-load tap changer connected to said tapping points and mounted within said tap-changer tank;

said tap changer including a terminal board mounted at the dividing line between said transformer tank and said tap-changer tank; and said tap-changer tank being mounted to said transformer tank such that said dividing line is directed obliquely outwardly and upwardly from the vertical plane in which the side wall of said transformer tank is substantially located.

2. Transformer apparatus according to claim 1, wherein the angle of the dividing line with said vertical plane is between 15° and 60°.

3. Transformer apparatus according to claim 2, wherein the portion of the side wall of said transformer tank which is located above said terminal board includes an opening with a cover, through which opening said terminal board is accessible.

4. Transformer according to claim 3, wherein said portion of the side wall of said transformer tank is substantially positioned in a plane which inclines outwardly and downwardly from said vertical plane.

* * * * *